US007743971B2

(12) United States Patent
DeVine et al.

(10) Patent No.: US 7,743,971 B2
(45) Date of Patent: Jun. 29, 2010

(54) FOOD AND BEVERAGE CARRIER AND METHOD

(75) Inventors: Christopher Michael DeVine, Chicago, IL (US); Todd Peter Hauptmann, Forest Park, IL (US); Carrie Pienias, Chicago, IL (US); Nancy Quesada, Calumet City, IL (US); Julie Tolhurst, Chicago, IL (US)

(73) Assignee: Levy (IP) Limited Partnership, Chicago, IL (US)

( * ) Notice: Subject to any disclaimer, the term of this patent is extended or adjusted under 35 U.S.C. 154(b) by 236 days.

(21) Appl. No.: 11/338,253

(22) Filed: Jan. 24, 2006

(65) Prior Publication Data

US 2007/0170231 A1 Jul. 26, 2007

(51) Int. Cl.
*B65D 5/468* (2006.01)

(52) U.S. Cl. ..... 229/117.16; 206/806; 220/771; 229/114; 229/117.13

(58) Field of Classification Search ..... 229/117.12, 229/117.13, 117.16, 114; 206/806; 220/769, 220/771; 248/27.8, 318, 339, 340, 341
See application file for complete search history.

(56) References Cited

U.S. PATENT DOCUMENTS

| | | | | | |
|---|---|---|---|---|---|
| 955,880 | A | * | 4/1910 | Jager | 206/806 |
| 1,656,072 | A | * | 1/1928 | Lukens | 220/771 |
| 2,611,528 | A | * | 9/1952 | Vadner | 229/122.3 |
| 2,704,179 | A | * | 3/1955 | Wilcox | 229/5.5 |
| 2,739,752 | A | * | 3/1956 | Pritchett | 229/117.13 |
| 2,926,834 | A | * | 3/1960 | Kaslow | 229/117.12 |
| 2,990,096 | A | * | 6/1961 | Crosby | 206/806 |
| 3,322,300 | A | * | 5/1967 | Cornelius | 206/504 |
| 3,955,747 | A | * | 5/1976 | Bell | 229/117.12 |
| 3,968,921 | A | | 7/1976 | Jewell | |
| D245,579 | S | | 8/1977 | Jewell | |
| 4,061,241 | A | | 12/1977 | Retelny | |
| D250,172 | S | | 11/1978 | Retelny | |
| 4,132,344 | A | | 1/1979 | Jewell | |
| D251,657 | S | | 4/1979 | Jewell | |
| 4,230,261 | A | * | 10/1980 | Austin | 229/117 |
| 4,355,758 | A | * | 10/1982 | Lavery | 206/806 |
| 4,512,512 | A | | 4/1985 | Fleming | |
| 4,550,873 | A | | 11/1985 | Fleming | |
| 4,653,685 | A | | 3/1987 | Leary et al. | |
| D292,483 | S | | 10/1987 | Commisso et al. | |
| D292,878 | S | | 11/1987 | Commisso et al. | |
| 4,711,389 | A | | 12/1987 | Alba et al. | |
| 4,714,164 | A | * | 12/1987 | Bachner | 206/518 |
| 4,869,385 | A | * | 9/1989 | Blinsinger | 248/318 |
| 4,981,254 | A | * | 1/1991 | Depper | 229/117.13 |
| D317,070 | S | | 5/1991 | Ott et al. | |
| D317,102 | S | | 5/1991 | Clark et al. | |

(Continued)

*Primary Examiner*—Gary E Elkins
(74) *Attorney, Agent, or Firm*—Ryndak & Suri LLP

(57) ABSTRACT

A carrier for food, beverages and other items and methods for carrying food, beverages and other items. The carrier is especially suitable for use at food and beverage concessions at sporting and entertainment venues and in fast-casual restaurants. The carrier is preferably made of paper and includes a carry tab which permits a customer to carry multiple carriers in one hand. The carry tab may include an aperture sized to accommodate the customer's thumb and fingers, providing for a sure and comfortable grip of the carrier. The carrier fits into a standard cup holder in the seating area at sporting and entertainment venues, or may hang from a hook provided in the seating area.

13 Claims, 14 Drawing Sheets

U.S. PATENT DOCUMENTS 5,012,971 A 5/1991 Cozzi et al.
5,044,773 A * 9/1991 Harms et al. ..... 206/806
5,052,615 A 10/1991 Ott et al.
5,060,851 A 10/1991 Lorenz
5,255,782 A * 10/1993 Carroll, Jr. ..... 220/771
5,350,071 A * 9/1994 Pond ..... 248/318
5,497,885 A 3/1996 Sussman
5,524,814 A 6/1996 Davis
5,605,279 A 2/1997 Adamek
5,733,616 A * 3/1998 Janicki et al. ..... 428/35.7
D401,142 S 11/1998 Adamek
5,842,632 A * 12/1998 Van Hest ..... 206/806
6,183,027 B1 2/2001 Tsao
6,390,299 B1 5/2002 Mellon et al.
D461,713 S 8/2002 Foreman
D462,904 S 9/2002 Mellon et al.
6,702,179 B2 3/2004 Chang
D508,378 S 8/2005 Bertulis
6,926,153 B2 * 8/2005 Chandaria ..... 229/117.12
6,932,214 B1 8/2005 Zimet
2002/0145295 A1 10/2002 Frank et al.
2003/0102363 A1 6/2003 Chang
2003/0106828 A1 6/2003 Hunter
2004/0040882 A1 3/2004 Hemingway et al.
2004/0118707 A1 6/2004 Sutton-Rainey et al.
2004/0159577 A1 8/2004 Hunter
2004/0164135 A1 * 8/2004 Gong et al. ..... 229/132
2004/0226989 A1 11/2004 Cook et al.
2004/0238403 A1 12/2004 Wright et al.
2005/0035009 A1 2/2005 Cuomo
2005/0092623 A1 5/2005 Cuomo
2005/0109639 A1 5/2005 Cuomo
2005/0167475 A1 8/2005 Graham

* cited by examiner

FOOD AND BEVERAGE CARRIER AND METHOD

FIELD OF THE INVENTION

The present invention relates to carriers for food, beverages and other items and methods for carrying food, beverages and other items. More particularly, the present invention relates to such carriers and methods suitable for use at food and beverage concessions at sporting and entertainment venues and in fast-casual restaurants.

BACKGROUND OF THE INVENTION

A need exists for a method and apparatus for customers of concessions at sporting and entertainment venues to transport several items with ease. It would be advantageous for such a method and apparatus to be suitable for use with both foods and beverages.

A need also exists for a method and device that will integrate easily into an existing concessions or fast-casual restaurant environment. It would be advantageous for such a method and apparatus to enable servers to carry multiple items per trip from a food preparation station to a sales counter.

In addition, a need exists for a method and apparatus that will boost sales of food and beverages by making it more convenient for a customer to purchase more items and transport them back to the seating area without concern about spilling or dropping the items.

Further, a need exists for a carrier that will fit into existing cup holders which are provided in the seating areas of many sporting and entertainment venues.

SUMMARY OF THE INVENTION

In accordance with one aspect of the present invention, a carrier suitable for holding food or a beverage in a cup is provided. The carrier is preferably made of paper and includes a carry tab which permits a customer to carry multiple carriers in one hand. The carry tab preferably has an aperture sized to accommodate the customer's thumb and fingers, providing for a sure and comfortable grip of the carriers.

In accordance with another aspect of the invention, a carrier is provided which fits into standard cup holders in seating areas at sporting and entertainment venues. Alternately, the carrier may hang from a hook provided in the seating area.

In accordance with still another aspect of the present invention, a method of transporting a plurality of food or beverage items in one hand is provided.

DETAILED DESCRIPTION OF THE INVENTION

In accordance with the present invention, new and useful carriers for foods, beverages and other items and methods for carrying foods, beverages and other items are provided.

Concession stands at sporting and entertainment venues such as stadiums, arenas and theatres offer a variety of food and beverage products to persons attending events at the venue. Typically, a customer must wait in line and place an order at the concession stand sales counter, and after being served, must transport the items purchased back to the seating area. One of the most significant customer concerns in such environments is the difficulty in carrying multiple items from the concession stand back to their seats. Known devices such as food boats and French fry cups are well suited for single orders, but become awkward and difficult to manage when buying multiple items, especially when buying for a family or group. Trays and slings can hold multiple items, but are often unwieldy and unbalanced, resulting in drops and spills. When the customer reaches his seat, there may be a cup holder to hold a single beverage, but no place other than one's lap or the floor to place food items.

The invention is an innovative carrier and method for carrying several items (typically food or beverage) with ease. Using the carrier of the invention, a customer can carry as many as four or five items in one hand. This alleviates indecision experienced by customers when placing their orders, as they no longer must worry about how to carry the items back to their seats. This increases sales for the concession. Further, the durability and inherent counter-balance of the carrier reduce spilling of beverages and foods, enhancing customer satisfaction and reducing spills on the floor of the venue and resulting clean-up costs.

Figure 1:
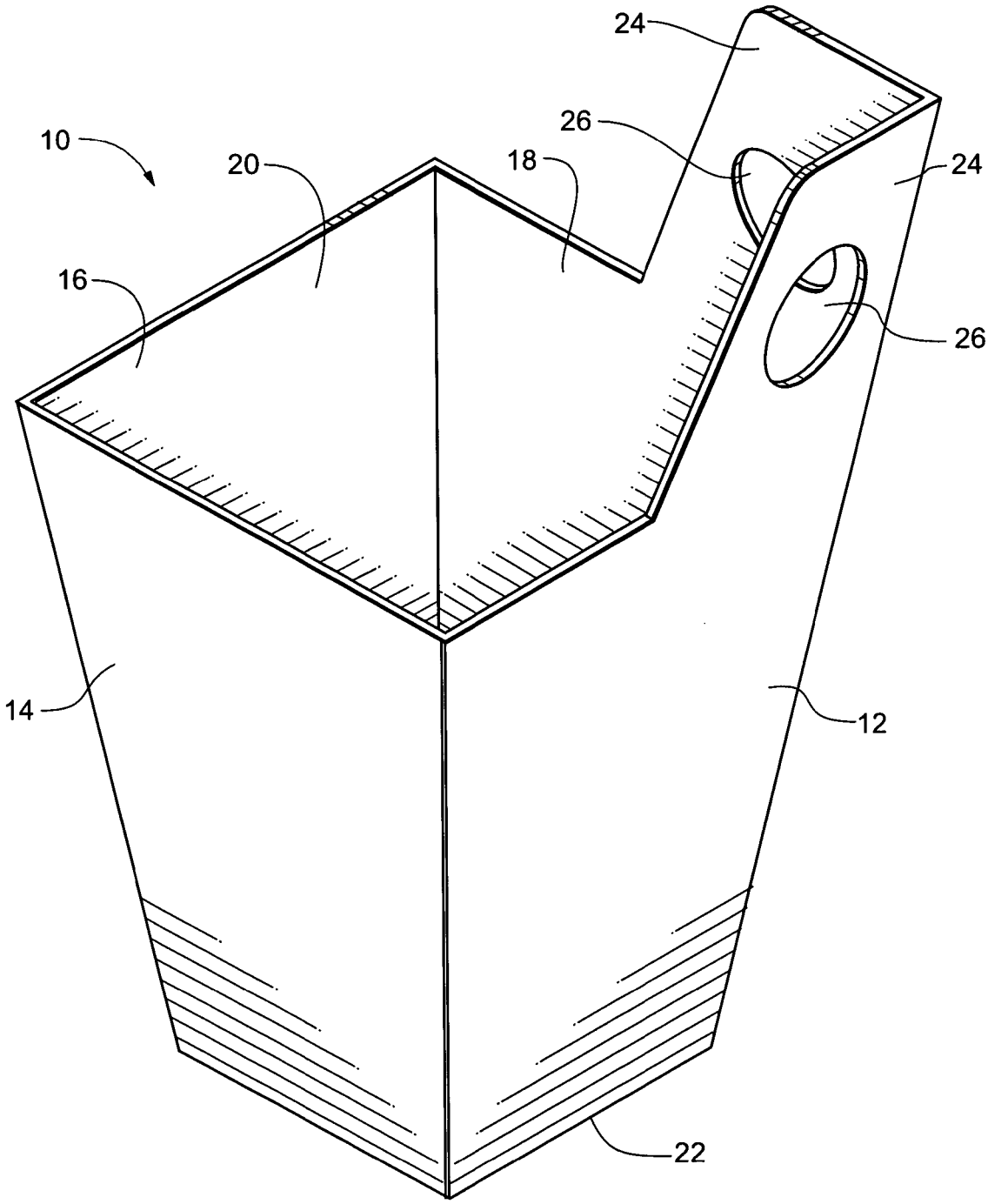
FIG. 1 is a perspective view of an exemplary carrier of the invention.
Figure 2:
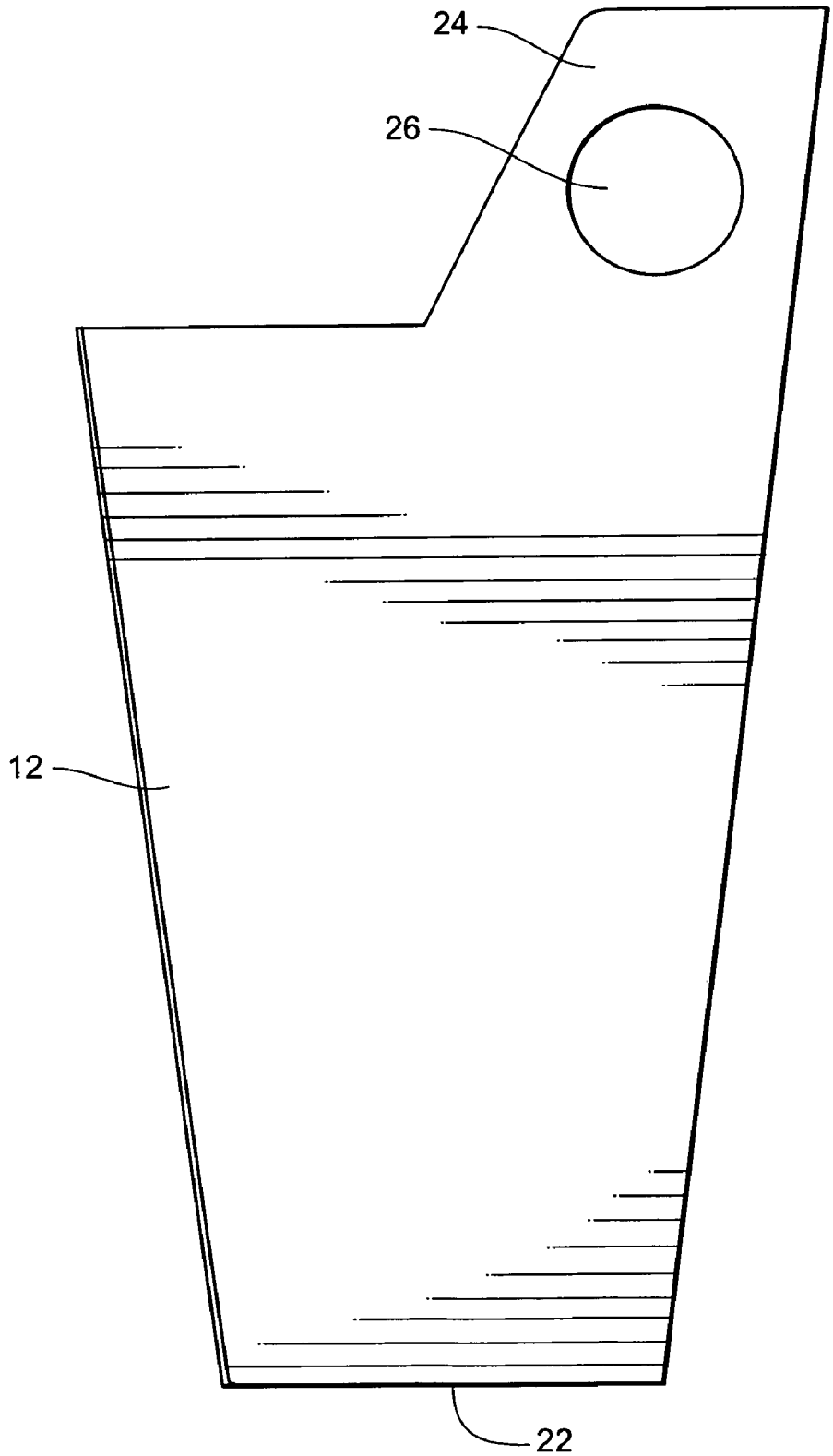
FIG. 2 is a front elevation view of the carrier of FIG. 1.
Figure 3:
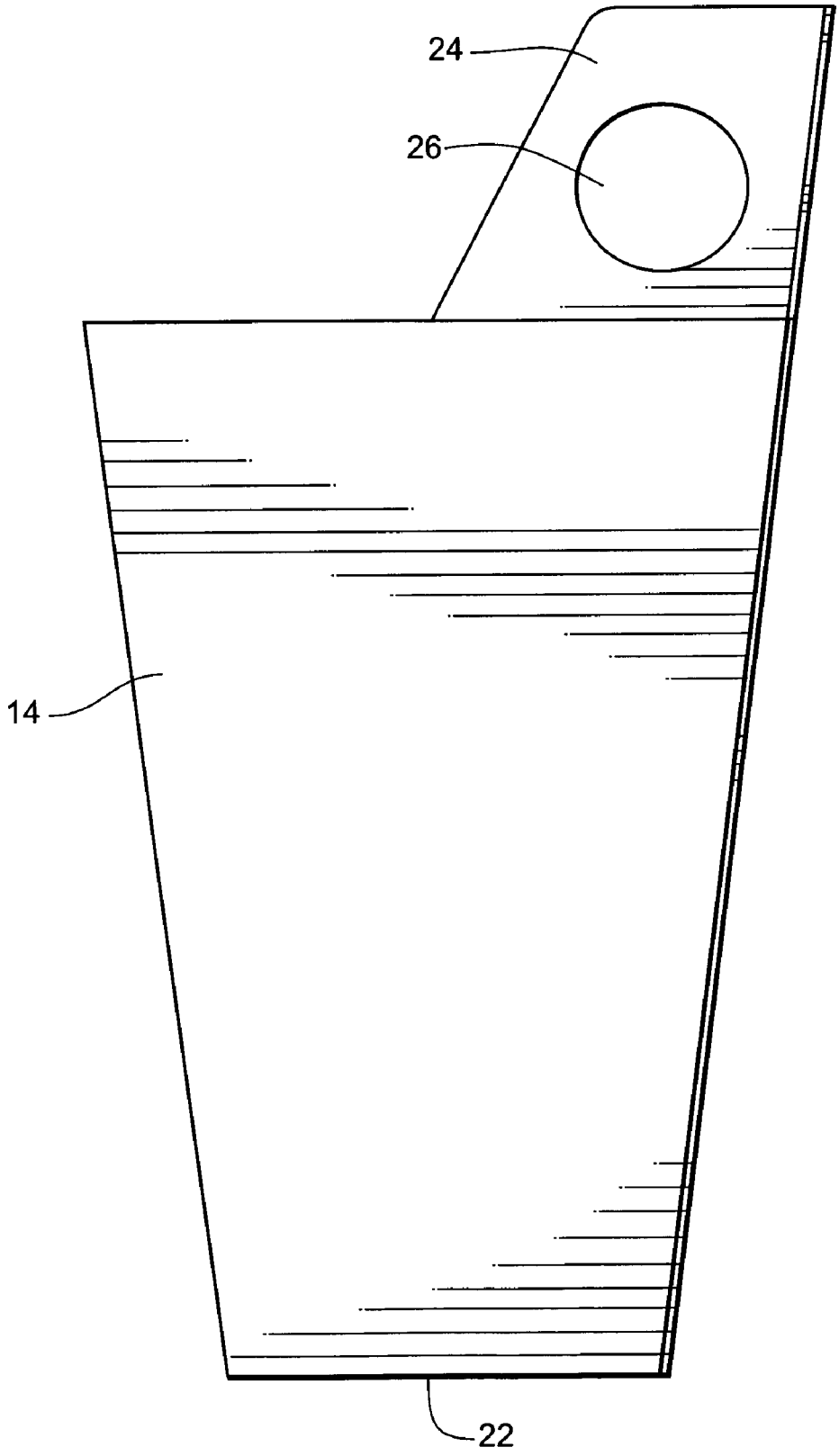
FIG. 3 is a side elevation view of the carrier of FIG. 1.
Figure 4:
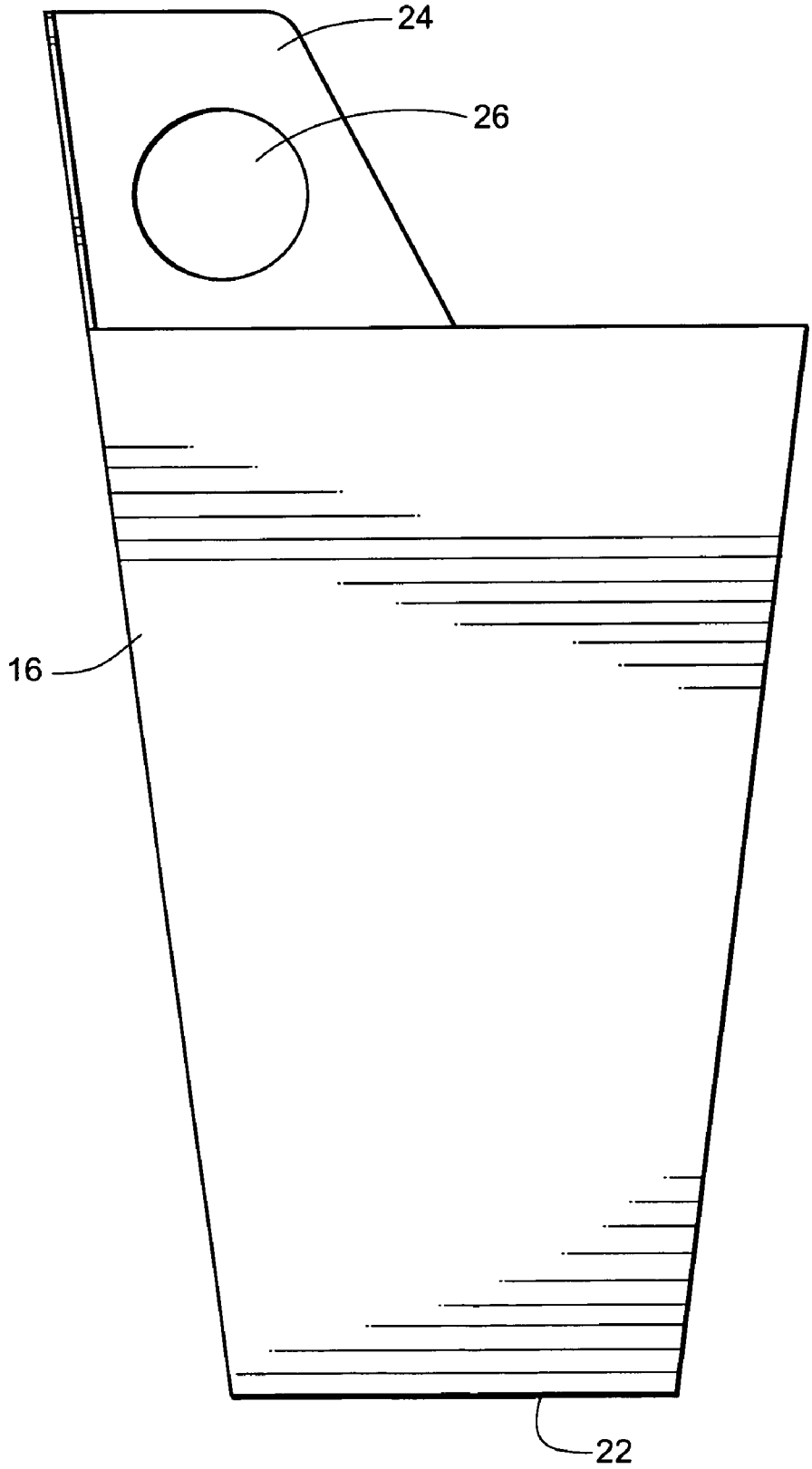
FIG. 4 is rear elevation view of the carrier of FIG. 1.
Figure 5:
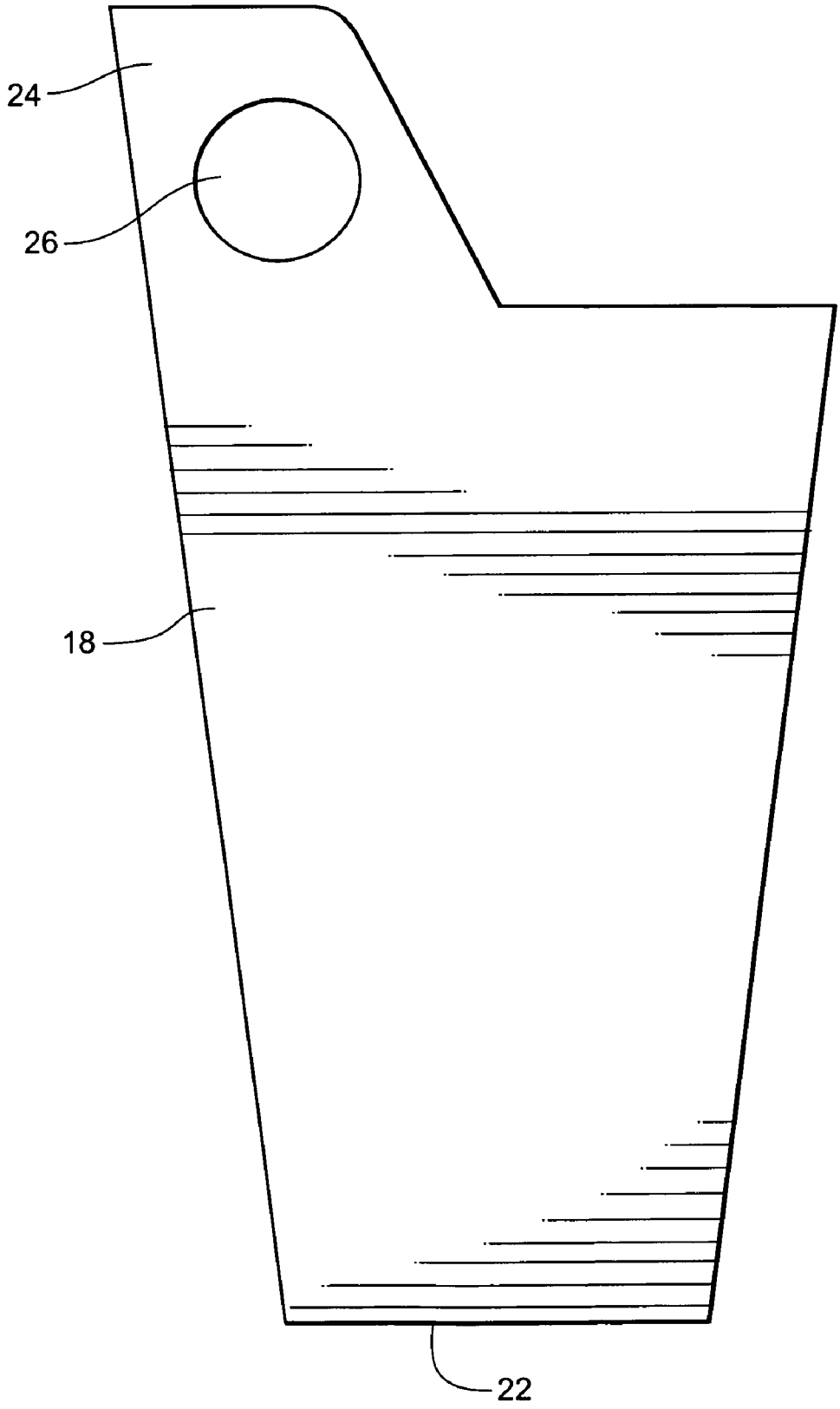
FIG. 5 is an opposite side elevation view of the carrier of FIG. 1.
Figure 6:
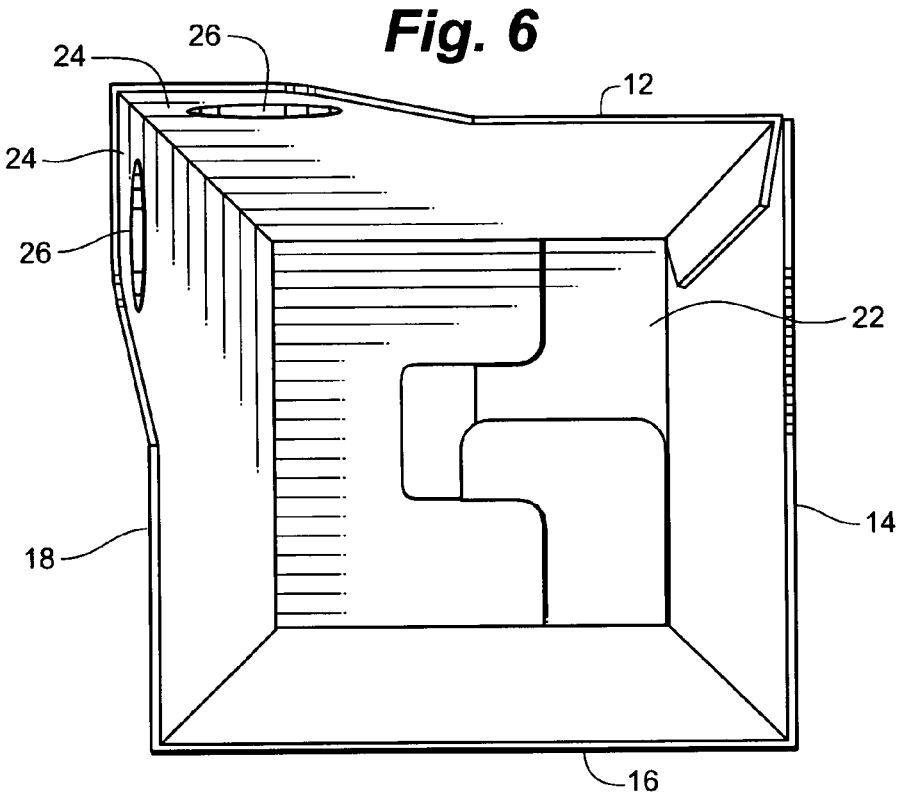
FIG. 6 is a top plan view of the carrier of FIG. 1.
Figure 7:
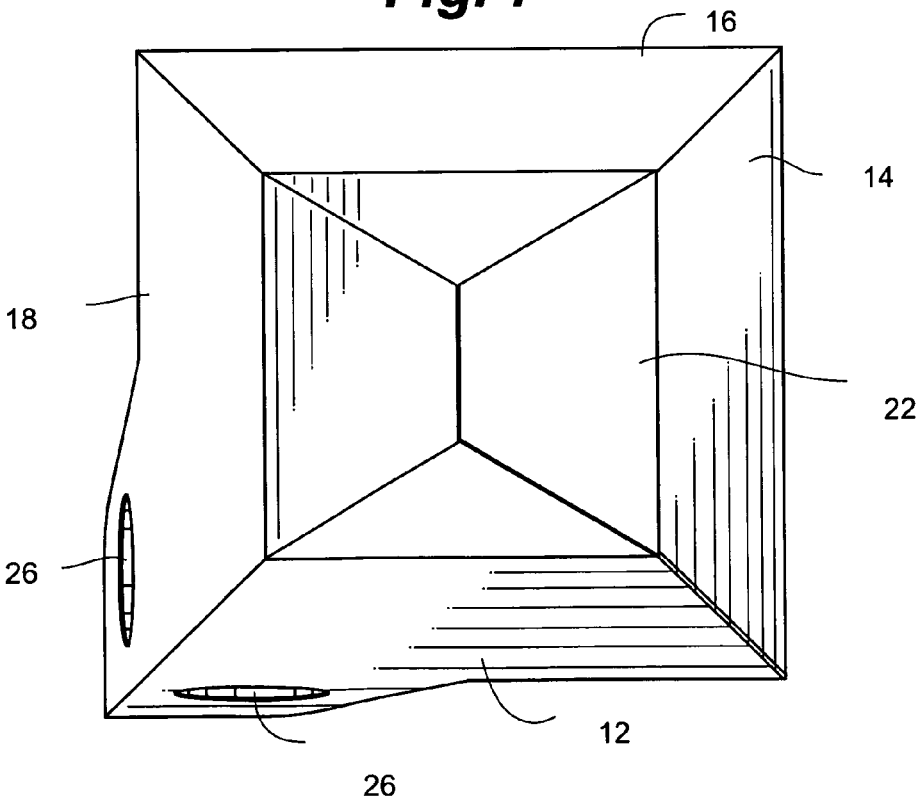
FIG. 7 is a bottom plan view of the carrier of FIG. 1.

Referring to FIGS. 1-7, and in particular to FIG. 1, a carrier 10 is formed with four walls 12, 14, 16 and 18, a square top opening 20 and a square base 22. Each of side walls 12, 14, 16 and 18 is tapered so that the base 22 of carrier 10 is somewhat smaller than top opening 20. Carry tabs 24 extend upwardly from two of the walls 12, 18 at the corner of carrier 10 where walls 12 and 18 are adjacent. A tab opening 26 is provided in each carry tab 24. Tab opening 26 may be round (circular) as shown, or may have any other shape suitable for insertion of a user's fingers and/or thumb.

Figure 8:
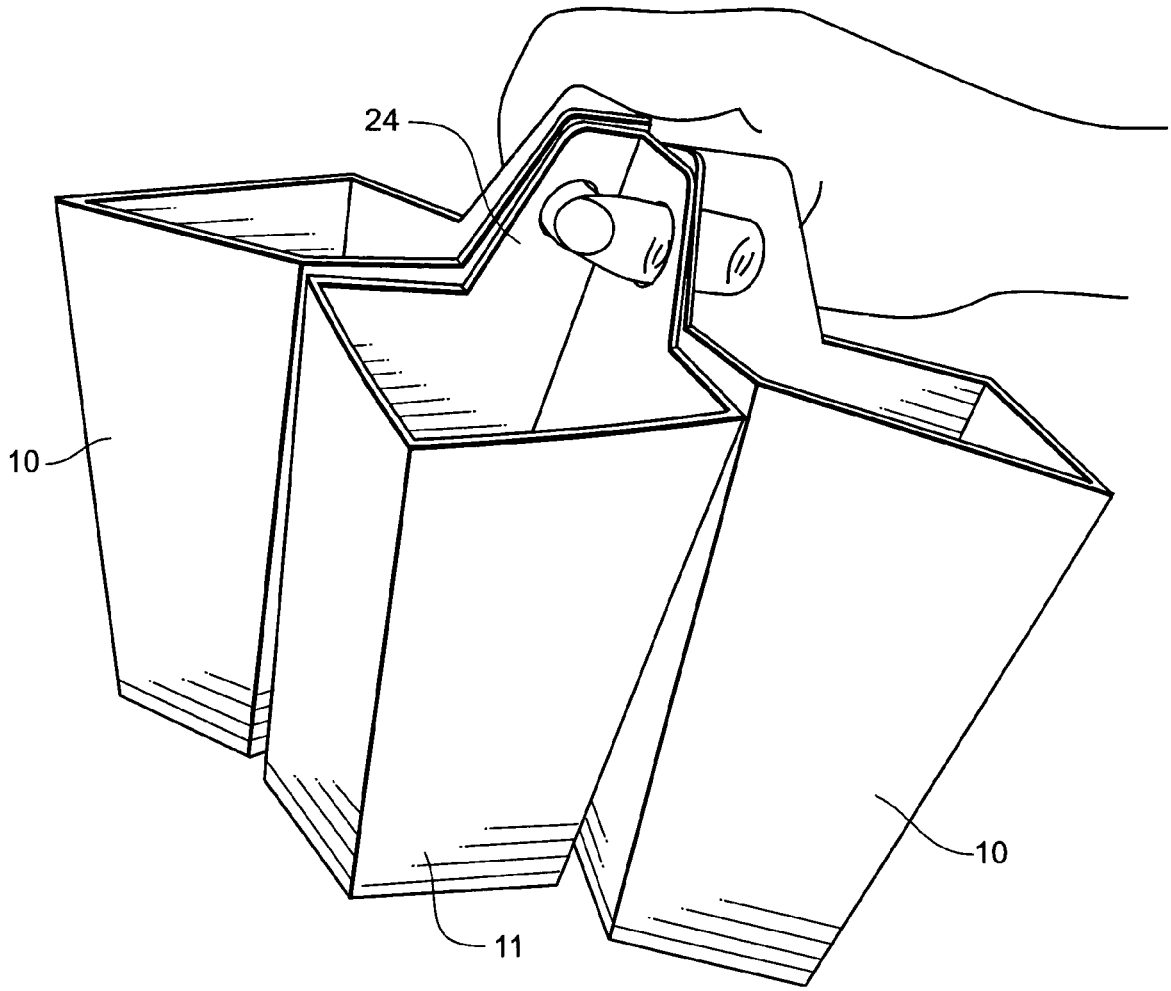
FIG. 8 illustrates how three of the carriers of FIG. 1 may be carried in a person's hand by inserting the thumb and fingers into the apertures in the carrying tabs of each carrier.

As shown in FIG. 8, three (or up to five) carriers 10 may be easily gripped in one hand by inserting the fingers and thumb through tab openings 26. Because carriers 10 are square, they fit together tightly and support one another, preventing possible imbalance and thus avoiding spills.

Figure 9:
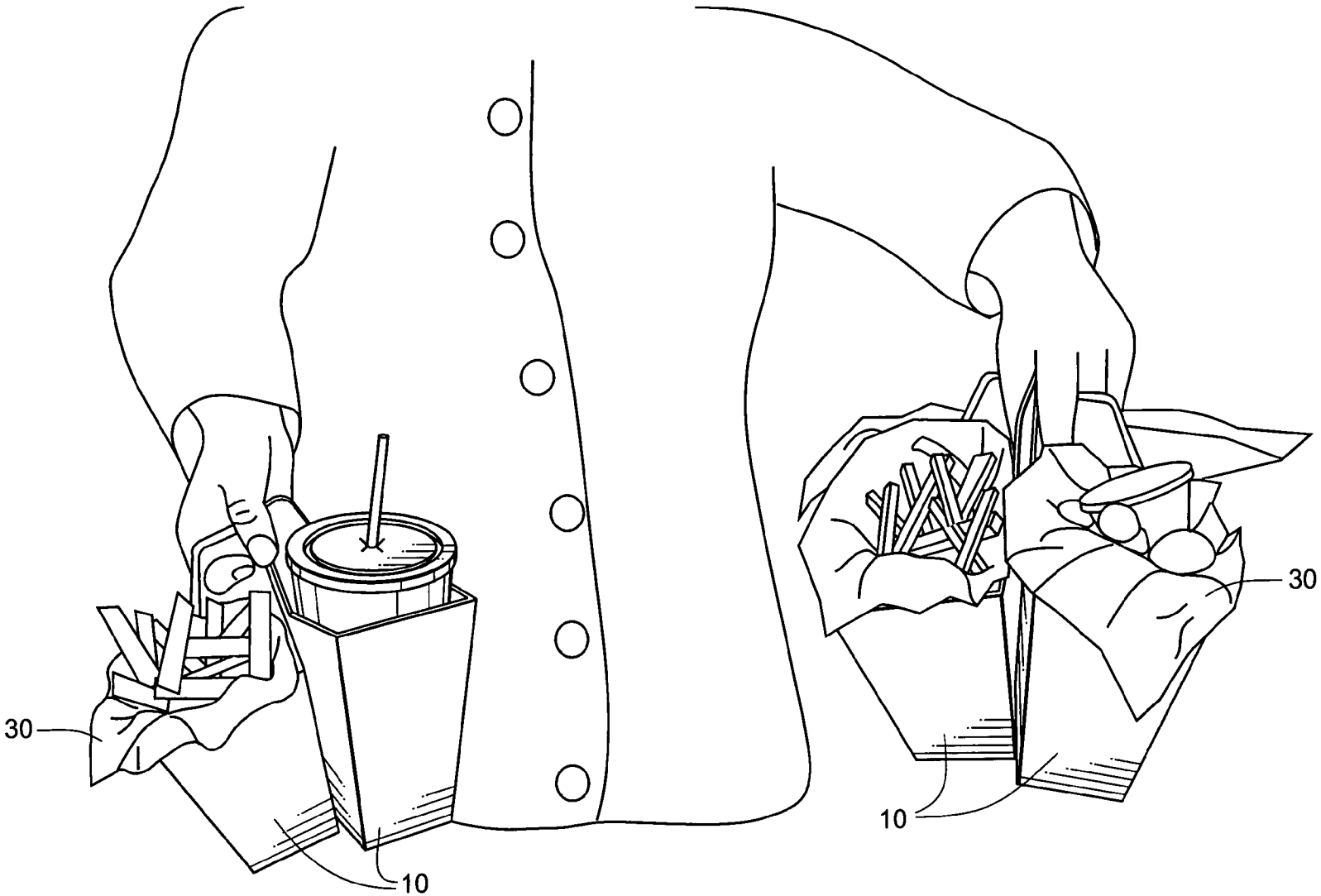
FIG. 9 illustrates how a plurality of the carriers of FIG. 1 may be carried in each hand.

As shown in FIG. 9, multiple (up to five) carriers 10 may easily be carried in each hand. While useful for a customer purchasing food and beverages for a large group, this is especially advantageous for a server, who can transport up to ten items at one time from a food preparation area to a sales counter. The ability to transport more items in a single trip speeds up customer service, reduces customer time spent waiting in line, and generally enhances customer satisfaction with the overall concession experience.

Figure 10:
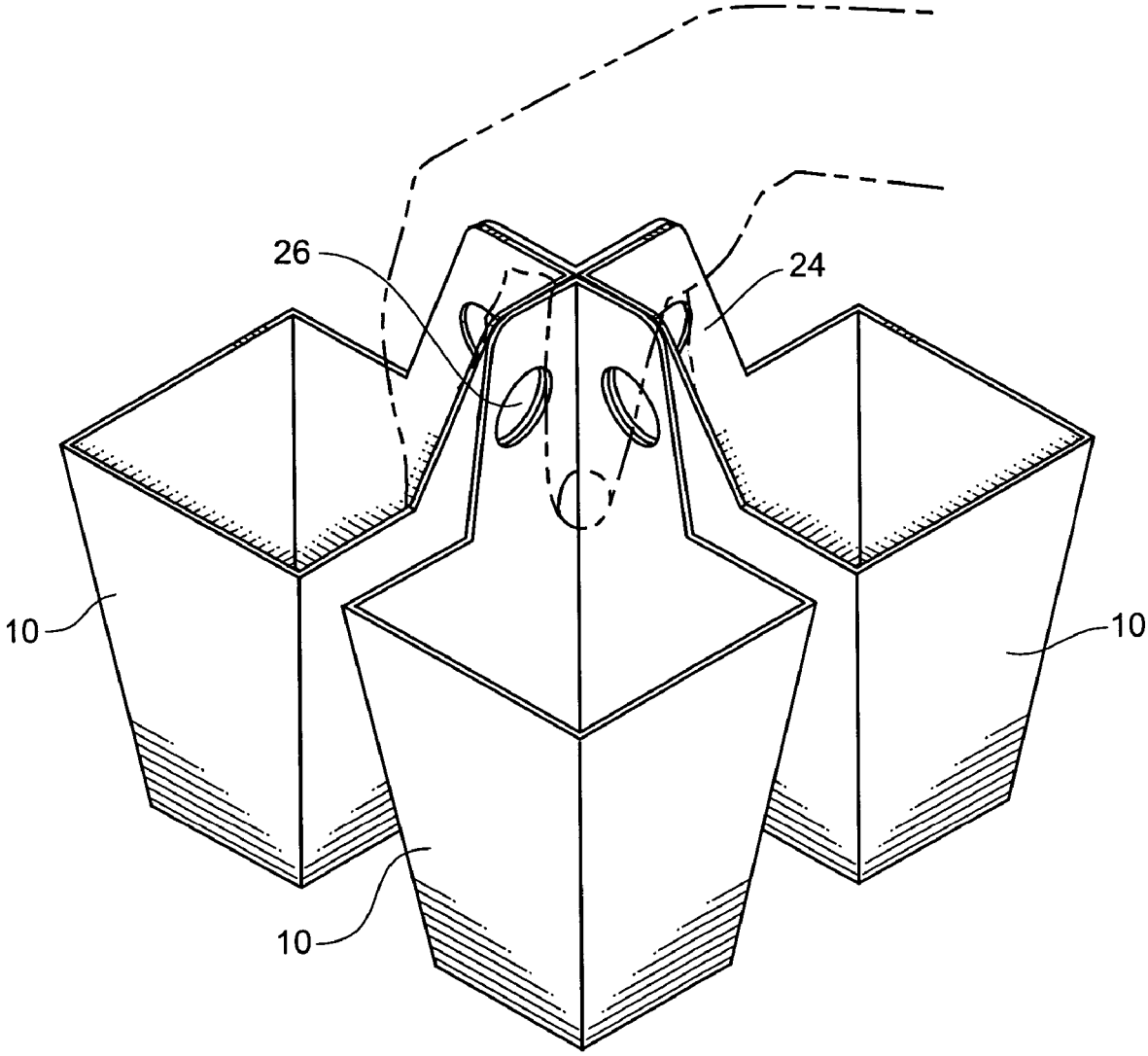
FIG. 10 illustrates an alternate method of how four of the carriers of FIG. 1 may be gripped by a person's hand.

An alternate way of gripping multiple carriers 10 is shown in FIG. 10. In this method, rather than inserting the fingers and thumb in tab openings 26, the fingers simply grip carry tabs 24. Again, because of the square shape of the carriers, they fit together snugly and make it easy to securely grip and carry them.

Figure 11:
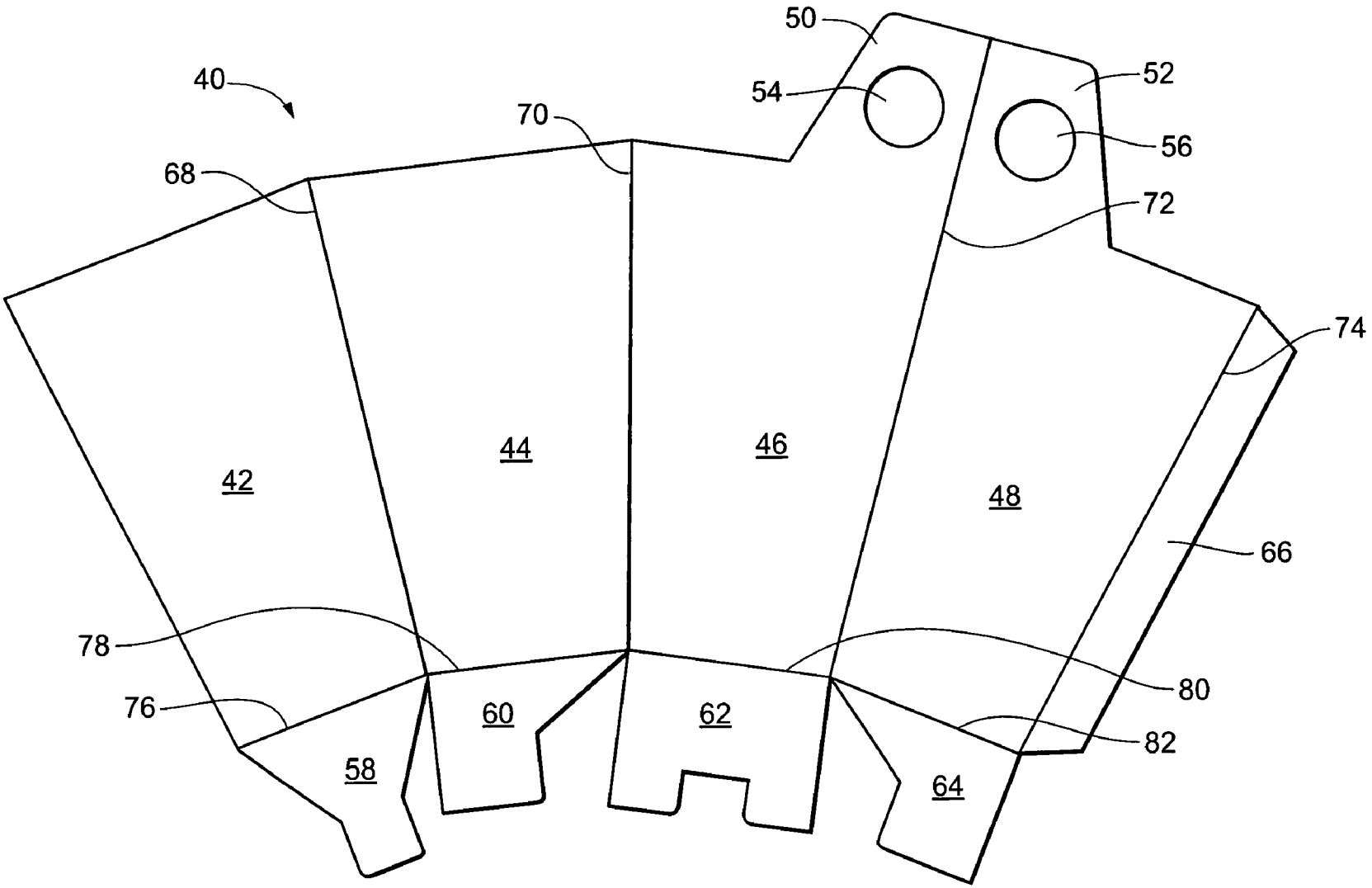
FIG. 11 is a view of the flat blank for making the carrier of FIG. 1.

Carrier 10 is formed from a blank 40 as shown in FIG. 11. Blank 40 may be made of coated food grade paper, cardboard, plastic or other suitable material as is well known in the art. Blank 40 includes sides 42, 44, 46, and 48. Carry tabs 50, 52 extend from sides 46, 48, respectively. In this exemplary embodiment, carry tabs 50, 52 are integrally formed in sides 46, 48. Alternately, the carry tabs may be made separately and attached to the sides by gluing, stapling or other suitable means. Tab openings 54, 56 are punched or otherwise formed in carry tabs 50, 52. In this embodiment, tab openings 54, 56 are circular, but they may be any other convenient shape that will accommodate a user's fingers and/or thumb. Bottom tabs 58, 60, 62 and 64 extend from walls 42, 44, 46, 48, respectively. Side tab 66 extends from wall 48. Scores 68, 70, 72 and 74 are provided between the sides 42, 44, 46, and 48 and side tab 66, respectively, and scores 76, 78, 80 and 82 are provided between sides 42, 44, 46 and 48 and bottom tabs 58, 60, 62 and 64, respectively, to facilitate folding and assembly of carrier 10, as discussed below.

Figure 12:
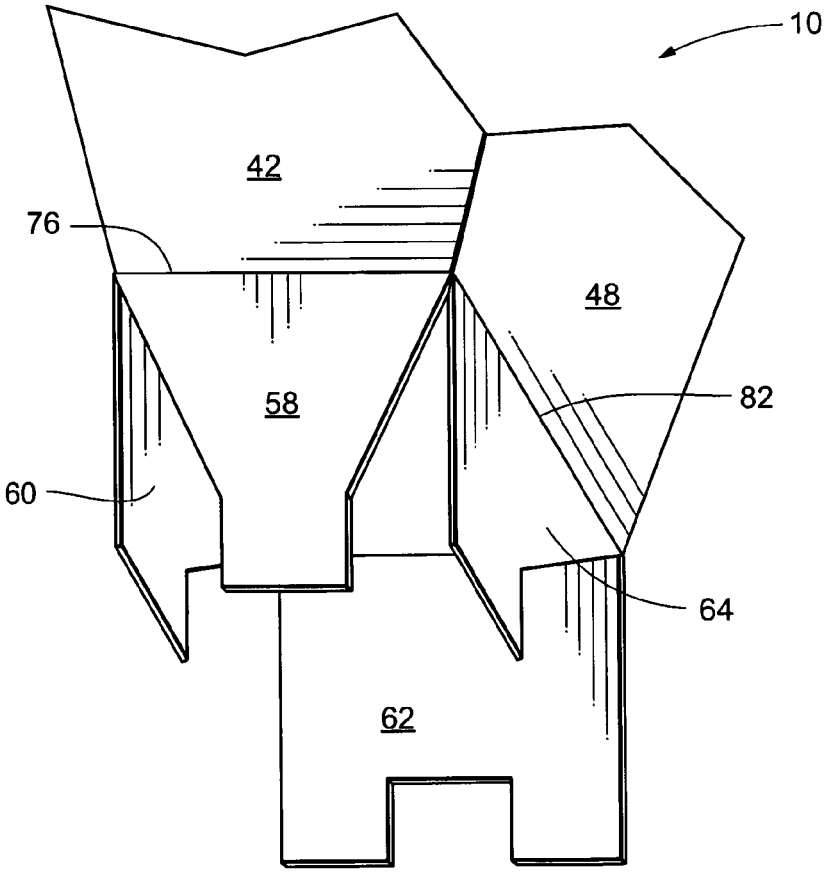
FIG. 12 is a perspective view showing the blank of FIG. 10 being folded to form the bottom of carrier of FIG. 1.
Figure 13:
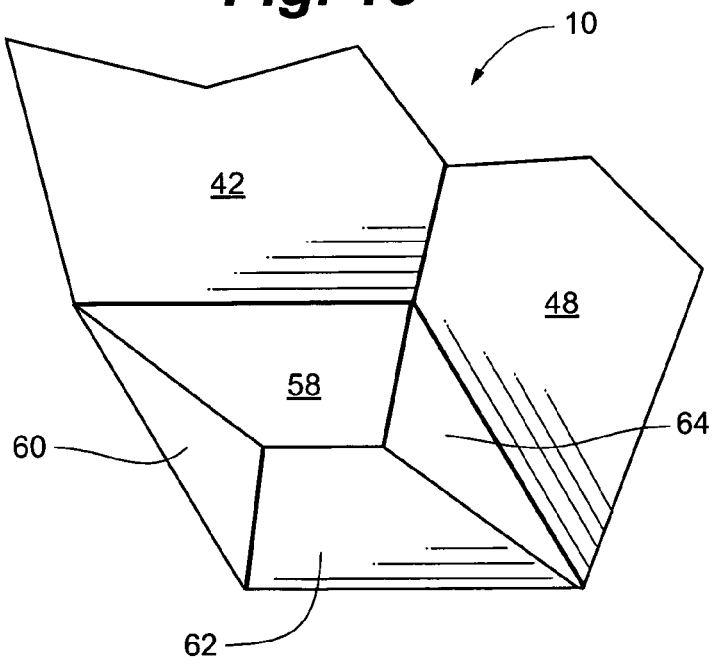
FIG. 13 is a perspective view of the assembled bottom of the carrier.

Referring to FIGS. 12-13, blank 40 is assembled into carrier 10 by folding along scores 68, 70, 72 and 74 to form the generally square carrier. Side tab 66 is attached to the inside of wall 42 by glue, staples or other means. Alternately, side tab 66 and wall 42 may have a tab and slot arrangement (not shown) by which they may be interlocked, as is known in the art. Bottom tabs 58, 60, 62 and 64 are folded along scores 76, 78, 80 and 82, respectively, and interlocked to form the bottom of carrier 10. Alternately, the bottom of carrier 10 may be an auto-locking bottom of the type generally known in the art.

Carriers 10 may be fully assembled and delivered to a venue ready to use. Alternately, for convenience in shipping and reduced storage space, blanks 40 may be partially assembled and delivered flat, with assembly completed on site. In the case of a carrier having an auto-locking bottom as mentioned above, carriers may be shipped and stored flat and then readily assembled up for use by simply pressing two opposite corners of the carton together, with the bottom panel components automatically interlocking to form a secure bottom for the carrier. Assembled carriers may be nested inside one another for convenience in transportation and storage of empty carriers.

In a preferred embodiment, carrier 10 has a height of about 5.5 inches, a top width of about 3.5 inches, and a bottom width of about 2.25 inches. A carrier of these dimensions will hold a 16 ounce food product or beverage cup and will fit into a standard cup holder. Tab openings 26 have a diameter of ⅞ inch, which comfortably accommodates the thumb and fingers of the customer.

Blank 40 is preferably made of coated food grade paper of sufficient thickness so as to be sturdy enough to hold the desired food and beverage products without collapsing. Paper is relatively inexpensive and environmentally friendly as compared to other possible materials such as plastic. Paper may also be readily imprinted with branding, logos, advertising, informational or entertainment content. For applications which may require greater strength or resistance to moisture, plastic or other materials may be used instead of paper.

Figure 14:
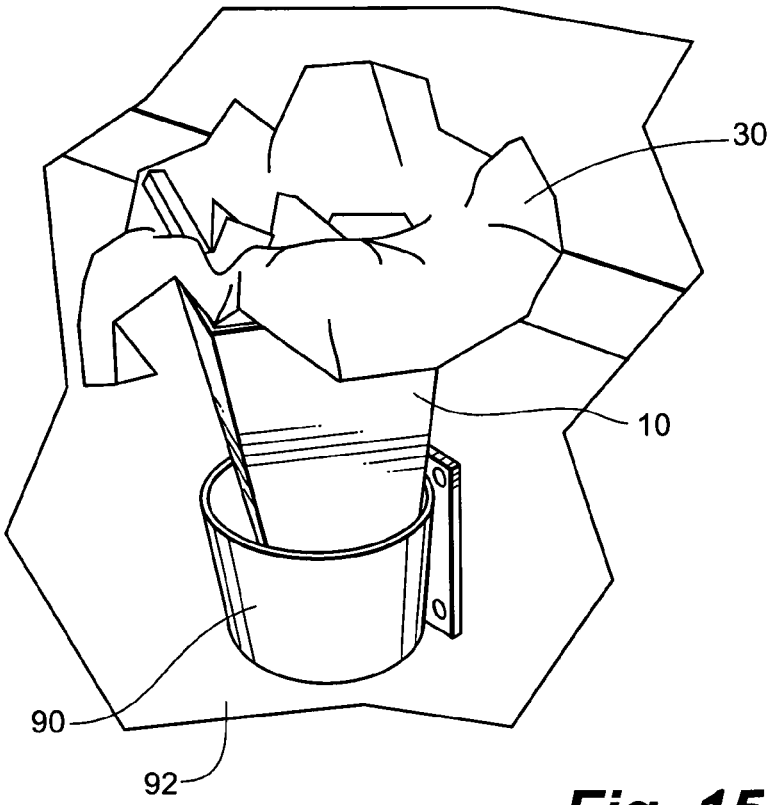
FIG. 14 is a view of the carrier of FIG. 1 inserted into a cup holder.
Figure 15:
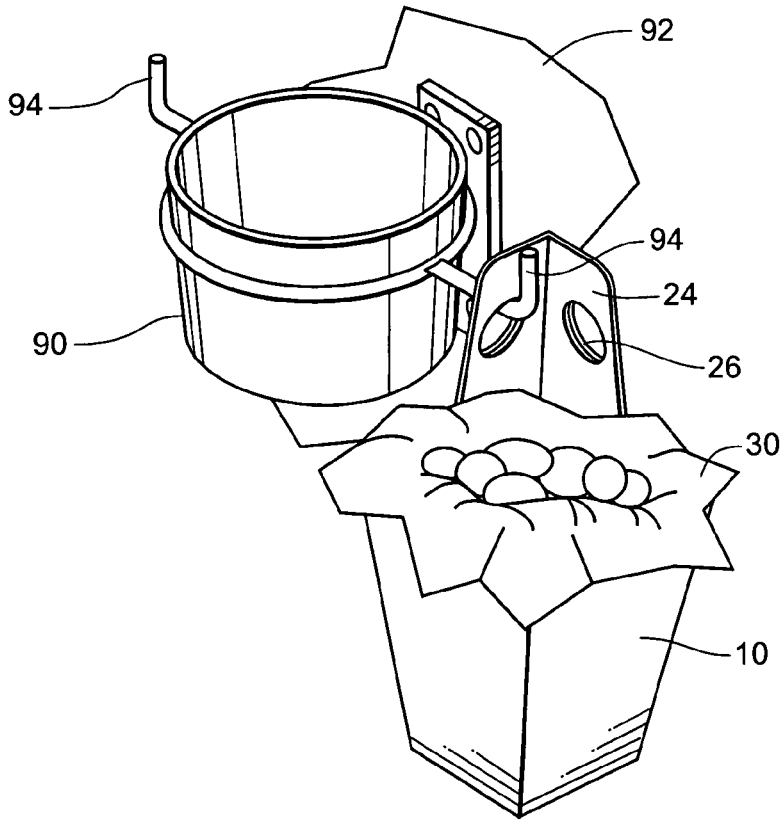
FIG. 15 is a view of the carrier of FIG. 1 hanging from a hook on a cup holder.

A wide range of food products may be placed in the carrier, for example, popcorn, chips, pretzels, French fries, fried vegetables, fried calamari, popcorn shrimp, etc. If desired, a paper liner 30 may be inserted into carrier 10 before adding the food, as shown in FIGS. 9, 14 and 15. A beverage container such as a cup, can or bottle may also be placed in the carrier. In addition, the carrier may be used to carry other types of merchandise which might be sold, such as souvenir items.

As shown in FIG. 14, carrier 10 may be inserted into a standard cup holder 90. Such cup holders are typically mounted on the back of the seat 92 in front of a seated patron at a venue. In some venues, the cup holders are provided in the armrests of the patron's seat. This is a convenience for the customer who is freed from having to hold the item in his lap or place it on the floor. Further, when in the cup holder, the food item and the branding on the carrier are readily visible to other patrons in the area, providing marketing benefits and enhancing sales. The carrier may also be used with the cup holders found in many vehicles.

In the alternative, cup holder 90 may be provided with one or more hooks 94 as shown in FIG. 15. In this case, carrier 10 is suspended from hook 94 by inserting a hook 94 through one of tab openings 26. If more than one hook is provided as shown in FIG. 15, more than one carrier 10 can be conveniently placed near the patron.

Figure 16:
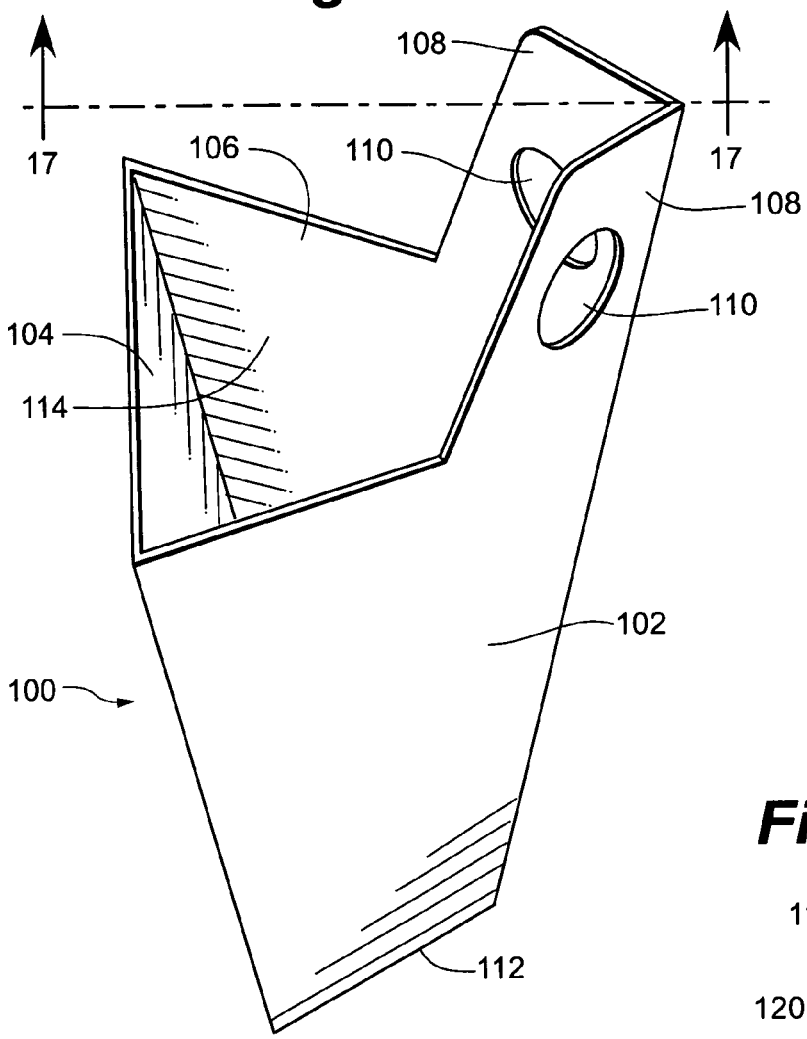
FIG. 16 is a perspective view of another embodiment of the carrier of the invention.
Figure 17:
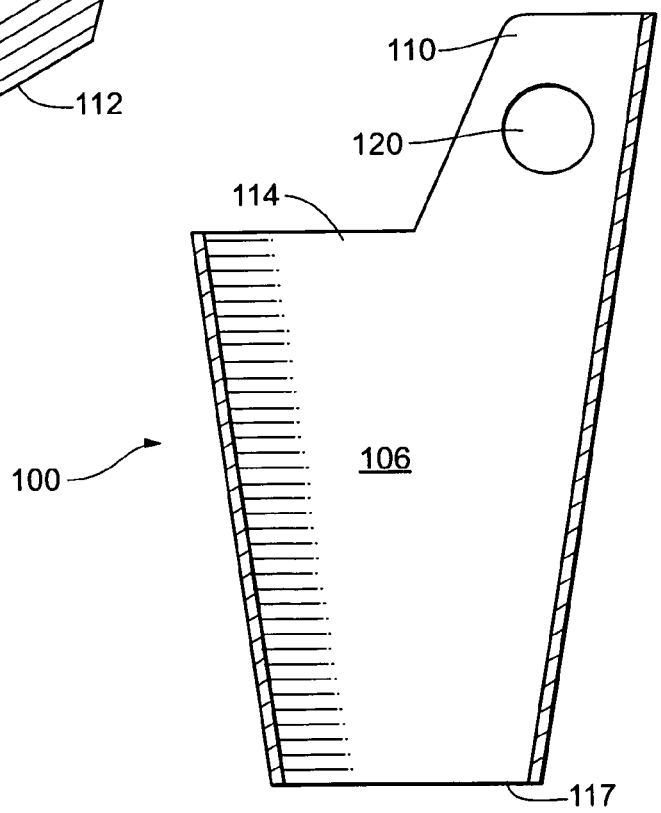
FIG. 17 is a cross-sectional view of the carrier of FIG. 15 taken along line 16A-16B.

FIGS. 16 and 17 illustrate an alternate embodiment of the carrier of the invention. Carrier 100 is similar to the carrier previously described, except that it has a triangular profile instead of a square profile. Carrier 100 includes three side walls 102, 104, 106 and is provided with extending carry tabs 108 having tab openings 110. As best seen in FIG. 17, which is a cross-sectional view of the carrier 100 of FIG. 16, sides 102, 104 and 106 are tapered so that base 112 is smaller then top opening 114. Carrier 100 is dimensioned so that it fits in a standard cup holder.

Figure 18:
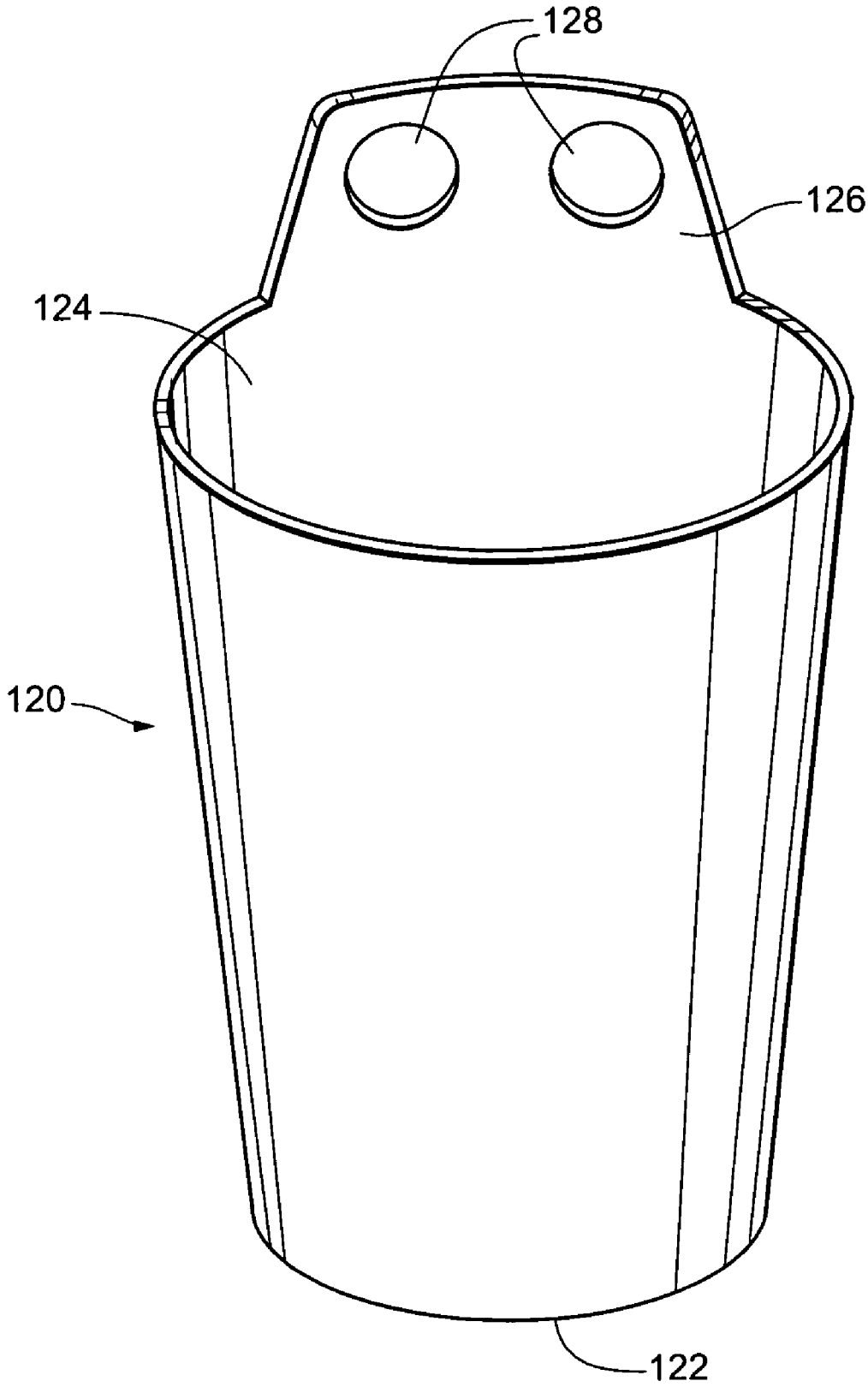
FIG. 18 is a perspective view of yet another embodiment of the invention.

FIG. 18 illustrates yet another embodiment of the carrier of the invention. Carrier 120 is generally cylindrical, and is tapered so that it is narrower at its bottom 122 than at its top opening 124. This profile allows carrier 120 to be easily inserted into and removed from a cup holder. Carry tab 128 extends upwardly from the cylindrical body of carrier 120, and at least one or preferably two tab openings 128 are provided for carrying with the fingers and thumb, and for hanging on a hook provided in the seating area. Carry tab 128 may be integrally formed with the cylindrical body of carrier 120, or made separately and attached by gluing, stapling or other suitable means.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A carrier comprising:

a plurality of side walls, each side wall having an upper edge, the upper edges defining an open top of the carrier, and each side wall adjoining an adjacent side wall at a corner of the carrier;

a bottom closure; and a carrier tab extending upwardly from the upper edges of two of the side walls at a corner where the said two side walls are adjacent, wherein the carrier tab has at least two apertures, each aperture generally coplanar with one of the said two side walls, respectively, and each aperture being configured and sized to receive an inserted thumb or finger of a user.

2. The carrier of claim 1 wherein the carrier tab is integral with the side wall of the carrier from which the carrier tab extends.

3. The carrier of claim 1 wherein the carrier tab is formed separately and attached to the side wall of the container.

4. An open-top carrier formed by folding a single sheet of material, the carrier comprising:

a flat bottom panel having a plurality of edges;

a plurality of side panels, each side panel having an upper edge, a lower edge and two opposite side edges, the lower edge of each side panel being connected to and extending upwardly from one of said bottom panel edges, each side panel being connected to each adjacent side panel along their respective side edges to form a corner of the carrier, and the upper edges defining the open top of the carrier; and at least one carrier tab extending upwardly from the upper edges of two of the side panels at a corner of the carrier where the two side panels are connected along their respective side edges, wherein the carrier tab has at least two apertures, each aperture generally coplanar with the said two side panels, respectively, and each aperture being configured and sized to receive an inserted thumb or finger of a user.

5. The carrier of claim 4 wherein the material is paper.

6. The carrier of claim 4 wherein the upper edge of each side panel is longer than the lower edge of the side panel such that the side panel is tapered so that the base of the carrier is smaller than the top opening of the carrier.

7. The carrier of claim 6 comprising four side panels wherein the base panel and the top opening are generally square.

8. The carrier of claim 6 comprising three side panels wherein the base panel and the top opening are generally triangular.

9. A blank for forming an open-top carrier, the blank comprising:

a plurality of side wall forming panels foldably and serially joined to each other along respective side edges thereof, each side wall forming panel having an upper edge and a lower edge, said side wall forming panels being of the same vertical extent, said lower edges of said side wall forming panels being joined to carrier bottom forming panels, and the upper edge of two of the side wall forming panels having a tab extending therefrom where the two side wall forming panels are connected along a common side edge, wherein the tab comprises two apertures, each aperture generally coplanar with one of the said two side wall forming panels, respectively, and each aperture being configured and sized to receive an inserted thumb or finger of a user.

10. The blank of claim 9 wherein the blank is made of paper.

11. A carrier comprising:

a plurality of side walls, each side wall having an upper edge, the upper edges defining an open top of the carrier, and each side wall adjoining an adjacent side wall at a corner of the carrier;

a bottom closure; and a carrier tab extending upwardly from the upper edges of two of the side walls at a corner where the said two side walls are adjacent, wherein the carrier tab comprises a first tab portion extending upwardly from the upper edge of one of the two side walls at the corner, a second tab portion extending upwardly from the upper edge of the other of the two side walls at the corner, the two tab portions being joined at an angle along a common side edge at the corner, and each tab portion having a tab opening therein, each tab opening being configured and sized to receive an inserted thumb or finger of a user.

12. The carrier of claim 11 wherein the angle is selected and the tab openings are located so as to permit a user to insert one finger through both tab openings simultaneously.

13. The carrier of claim 11 wherein the open top of the carrier is lidless and substantially unobstructed.

* * * * *